US006283350B1

(12) United States Patent
Gottmeier et al.

(10) Patent No.: US 6,283,350 B1
(45) Date of Patent: Sep. 4, 2001

(54) BACKPACK

(76) Inventors: Mario Gottmeier; Manuela Lagger, both of Hugo-Eckener-Strasse 5, D-86159 Augsburg (DE)

( * ) Notice: Subject to any disclaimer, the term of this patent is extended or adjusted under 35 U.S.C. 154(b) by 0 days.

(21) Appl. No.: 09/520,285

(22) Filed: Mar. 7, 2000

(51) Int. Cl.[7] ..... A45F 3/04

(52) U.S. Cl. ..... 224/639; 224/638; 224/627

(58) Field of Search ..... 224/637, 638, 224/639, 640, 627, 153, 623, 624, 625, 626, 664; 182/3; 244/151 R, 151 A

(56) References Cited

U.S. PATENT DOCUMENTS

| | | | | |
|---|---|---|---|---|
| 1,177,927 | * | 4/1916 | Calthrop | 182/3 |
| 1,920,408 | * | 8/1933 | Lafayeet | 224/151 R |
| 2,108,716 | * | 2/1938 | Kuhlemann | 244/151 R |
| 2,464,719 | * | 3/1949 | Quilter | 244/151 R |
| 2,516,004 | * | 7/1950 | Kajdan | 244/151 R |
| 2,531,442 | * | 11/1950 | Junker | 244/151 A |
| 5,125,718 | * | 6/1992 | Czernakowski et al. | 297/484 |
| 5,598,963 | * | 2/1997 | Buswell | 224/664 |
| 5,873,506 | | 2/1999 | Golling et al. . | |
| 5,950,894 | * | 9/1999 | Haber | 224/639 |

FOREIGN PATENT DOCUMENTS

| | | | |
|---|---|---|---|
| 296 15 828 | | 1/1997 | (DE) . |
| 981 193 | | 5/1951 | (FR) . |
| 2 630 897 | | 5/1988 | (FR) . |
| 11753 | * | 5/1910 | (GB) 224/209 |
| 9-056418 | | 4/1997 | (JP) . |

* cited by examiner

*Primary Examiner*—Gregory M. Vidovich

(57) ABSTRACT

A backpack (1) has two shoulder straps (2, 3) extending obliquely downward crosswise from one or the other side of the upper end area (4) of the backpack (1) to the lower end area (5) and each consisting of an upper portion (6, 7) and a lower portion (8, 9) which are interconnected by a buckle in the chest area. The buckle is formed by a snap buckle (11) comprising a snap-in part (12) and a receiving part (13). The upper portion (6) of the first shoulder strap (2) and the lower portion (9) of the second shoulder strap (3) are fastened to the snap-in part (12), and the upper portion (7) of the second shoulder strap (3) and the lower portion (8) of the first shoulder strap (2) to the receiving part (13).

10 Claims, 1 Drawing Sheet

FIG.1
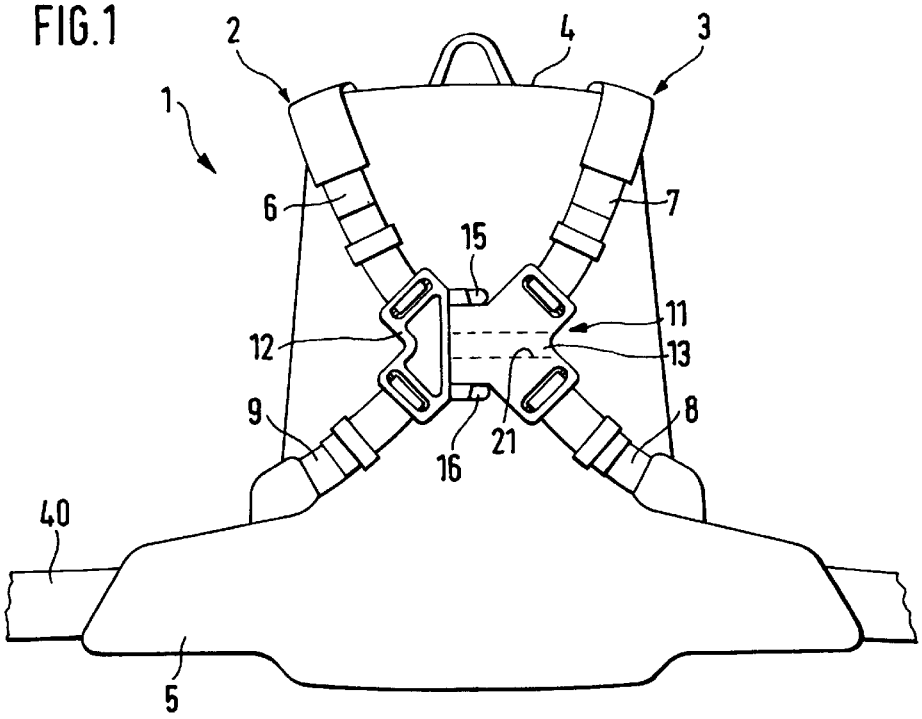
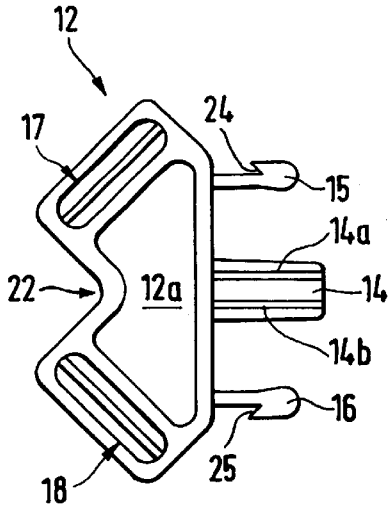
FIG.2
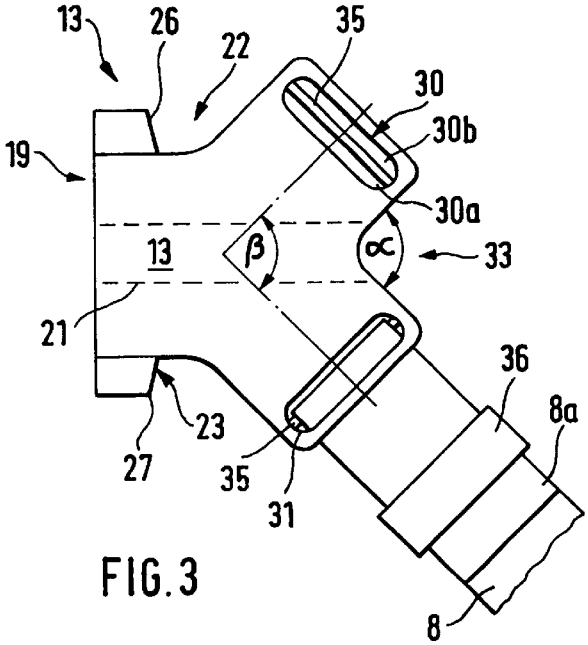
FIG.3

BACKPACK

FIELD OF THE INVENTION

This invention relates to a backpack with crosswise shoulder.

BACKGROUND OF THE INVENTION

Some backpacks are in particular for use in sports and leisure activities involving more or less pronounced motions of the arms obliquely to the direction of locomotion, in particular in the form of pendulum motion, for example in-line skating or skiing.

One such backpack is known, DE 296 15 828 U/U.S. Pat. No. 5,873,506. This backpack has an obliquely extending main shoulder strap with a lengthwise displaceable slide provided with two buckles to which the upper and lower portions of the other shoulder strap are alternatively fastenable.

The known backpack permits one- and double-sided wearing without faulty posture. Along with maximum freedom of movement it achieves a uniform weight distribution without cramping of cervical spine and back muscles and with relief of the spinal column.

However, the known backpack is not put on in the accustomed fashion by extending the arms through the two shoulder straps. One instead first draws the main shoulders strap over one's head and then fastens one or the other portion of the other shoulder strap alternatively to the slide. Use of the known backpack therefore requires instruction by expert personnel.

SUMMARY OF THE INVENTION

The object of the invention is to make it considerably easier to put on a backpack.

In the backpack of this invention, a snap buckle comprising a snap-in part and a receiving part is provided in the chest area. The upper portion of the first shoulder strap and the lower portion of the second shoulder strap are fastened to the snap-in part of the snap buckle. The upper portion of the second shoulder strap and the lower portion of the first shoulder strap to the receiving part.

When the snap buckle is open, a strap consisting of upper and lower strap portions connected by snap-in or receiving part is thus formed on each side. To put on the backpack one can therefore slip one arm through the strap on one side and the other arm through the strap on the other side in accustomed fashion when the buckle is open. Subsequently one need only snap the buckle together. It is thus extremely easy to put on the known backpack.

While the snap-in part is preferably frame-shaped, the receiving part is preferably formed by a plate. Each part preferably has two slot-shaped openings disposed at an angle. The upper portion of the first shoulder strap and lower portion of the second shoulder strap are guided through the two slot-shaped openings in the snap-in part. The upper portion of the second shoulder strap and lower portion of the first shoulder strap through the two slot-shaped openings in the receiving part. The force is guided by the straps uniformly through the slot-shaped openings in the snap-in part and receiving part into the two parts which form a massive assembly when the snap-in part is inserted. Therefore, heavy backpacks can also be formed according to the invention.

Since in the nested parts, the snap-in part and the receiving part, the force extends crosswise in accordance with the course of the straps, one can save material by providing recesses in the two parts in the areas outside the crosswise course of the force. Thus, both the snap-in part can have a recess between its two slot-shaped openings and the receiving part between its two slot-shaped openings.

For fastening and for shortening or lengthening the four strap portions, the upper and lower portions of the first shoulder strap and the upper and lower portions of the second shoulder strap, the slot-shaped openings preferably each have a center longitudinal bar which the particular strap portion twines around. That is, the free ends of the strap portions are inserted with their free end around the longitudinal bar through the particular slot on the side facing the snap-in part or receiving part and then through the slot in the reverse direction on the side facing away from the receiving part or snap-in part. Each slot is thus formed as a clasp for fastening and for changing the length of the strap portion between buckle and backpack.

So that the free end of the particular strap portion is additionally fixed after insertion through the slot, a loop is preferably provided around the particular strap portion between the snap-in or receiving part and the fastening of the particular strap portion to the backpack. This loop advantageously consists of a rubber-elastic band.

BRIEF DESCRIPTION OF THE DRAWINGS

In the following an embodiment of the inventive backpack with be explained in more detail with reference to the drawing, in which:

FIG. 1 shows the front view of a backpack; and

FIG. 2 and FIG. 3 show plan views of, respectively, the snap-in part and receiving part of the snap buckle. A strap portion is shown fastened to the receiving part.

DETAILED DESCRIPTION

According to FIG. 1, backpack 1 has two shoulder straps 2 and 3 extending obliquely downward crosswise from one or the other side of upper end area 4 of the pouch 41 of the backpack to lower end area 5 of the pouch. Each shoulder strap 2, 3 consists of an upper portion 6, 7 respectively, and a lower portion 8, 9, respectively.

In the chest area, snap buckle 11 comprising snap-in part 12 and receiving part 13 is provided. Upper portion 6 of first shoulder strap 2 and lower portion 9 of second shoulder strap 3 are fastened to snap-in part 12. Upper portion 7 of second shoulder strap 3 and lower portion 8 of first shoulder strap 2 to receiving part 13.

As seen in FIG. 2, snap-in part 12 is formed by a frame with opening 12*a*. On one side of the frame there is a guide tongue 14 with longitudinal ribs 14*a*, 14*b*. Outwardly loaded flexible tongues 15, 16 are located on each side of the guide tongue and are integrally fastened to the frame. For fastening upper shoulder strap portion 6 and lower shoulder strap portion 9 two slot-shaped openings 17, 18 disposed at an angle are provided in snap-in part 12. The strap portions 6, 9 are guided, respectively, through opening 17 and 18.

Receiving part 13, see FIG. 3, is formed by a plate which is hollow inside. Guide 21 (shown by dashed lines in FIG. 1) for guide tongue 14 extends from insertion opening 19 into the cavity in the plate of receiving part 13. Longitudinal ribs 14*a*, 14*b* are guided on guide 21.

On the two narrow side walls of the plate there are openings 22, 23 through which the outer sides of flexible tongues 15, 16 pass when the insertion part is inserted. On the side facing openings 22, 23 flexible tongues 15, 16 are provided with undercut snap-in surfaces 24, 25 which engage over stops 26, 27, respectively, on receiving part 13 when the snap buckle is closed. In the plate of receiving part 13 there are, similarly as in snap-in part 12, two slot-shaped openings 30, 31 disposed at an angle (β) through which upper portion 7 of second shoulder strap 3 ad lower portion 8 of first shoulder strap 2 are guided, respectively.

Snap-in part 12 has recess 32 between the two slot-shaped openings 17, 18 on the side facing away from guide tongue 14 and the two flexible tongues 15, 16. Similarly, the plate of receiving part 13 is provided with recess 33 between the two slot-shaped openings 30, 31 on the narrow side facing away from insertion opening 19. When parts 12 and 13 are fitted together, buckle 11 is a rigid unit.

Recesses 32, 33 are of angular form, the sides of angle α, i.e., the edges of recesses 32, 33, extending perpendicular to adjacent longitudinal slot opening 17, 18 or 30, 31. Angle α can be for example 90° to 120°. The two longitudinal slot openings 17, 18 in the plate of snap-in part 12 and the two longitudinal slot openings 30, 31 in the plate of receiving part 13 can enclose angle β of 90° to 120° for example.

Slot-shaped openings 17, 18, 30, 31 each have longitudinal bar 35 so that each slot-shaped opening 17, 18, 30, 31 is divided into portion 30*a* facing particular part 12, 13 and portion 30*b* facing away from the particular part, as illustrated in FIG. 3 for opening 30 of receiving part 13. Slot-shaped openings 17, 18, 30, 31 thus form a clasp for fastening particular strap portion 6, 7, 8 or 9 and for adjusting its length between buckle 11 and upper or lower end area 4, 5 of the backpack.

For this purpose, particular portion 6 to 9 is inserted with its free end through partial slot 30*a*, around bar 35 and then in the reverse direction through other partial slot 30*b* so that strap portion 8 forms with its free end 8*a* a loop around bar 35. In order to fix free end 8*a*, loop or ring 36 consisting of a rubber-elastic band is wound around strap portion 8 for free end 8*a* to be stretched through (FIG. 3). The other strap portions 6, 7 and 9 are fastened in the same way. This permits each strap portion 6 to 9 to be fixed to particular part 12, 13 and at the same time individually shortened or lengthened.

What is claimed is:

1. A backpack, said backpack comprising:

pouch, said pouch having first and second opposed sides, an upper end and a lower end spaced from the upper end;

first and second shoulder straps, said first shoulder strap consisting of an upper portion that extends diagonally downwardly from the first side of the upper end of said pouch and a separate lower portion that extends diagonally upwardly from the second side of the lower end of said pouch, said second shoulder strap consisting of an upper portion that extends diagonally downwardly from the second side of the upper end of said pouch and a separate lower portion that extends diagonally upwardly from the first side of the lower end of said pouch;

a snap-in buckle, said buckle having first and second parts that are configured to releaseably snap together to form a rigid unit, wherein: each said buckle part has two elongated slots for receiving individual strap portions; the elongated slots each have a lateral axis; said first buckle part is shaped so that the lateral axes of the elongated slots of said first buckle part are offset by an angle β; said second buckle part is shaped so that the lateral axes of the elongated slots of said second buckle part are offset by angle β; said first shoulder strap upper portion is looped through a first of said elongated slots of said first buckle part so that an adjustable length section of the first shoulder strap upper portion extends from said carrying pouch to said first buckle part; said second shoulder strap lower portion is looped through a second of said elongated slots of said first buckle part so that an adjustable length section of the second shoulder strap lower portion extends from said carrying pouch to said first buckle part; said second shoulder strap upper portion is looped through a first of said elongated slots of said second buckle part so that an adjustable length section of the second shoulder strap upper portion extends from said carrying pouch to said second buckle part; and said first shoulder strap lower portion is looped through a second of said elongated slots of said second buckle part so that an adjustable length section of the first shoulder strap lower portion extends from said carrying pouch to said second buckle part.

2. The backpack of claim 1, wherein:

one of said first or second buckle parts has a guide tongue and two flexible tongues, each said flexible tongue being located on a separate side of said guide tongue; and the other of said second or first buckle parts is shaped to have a cavity for receiving the guide tongue and two auxiliary openings, each auxiliary opening being positioned to receive a separate one of said flexible tongues.

3. The backpack of claim 2, wherein:

said first buckle part is formed to have said guide tongue and said flexible tongue; and said second buckle part is formed to have the cavity for receiving said guide tongue and the auxiliary openings for receiving said flexible tongues.

4. The backpack of claim 2, wherein angle β is between 90° and 120°.

5. The backpack of claim 1, wherein angle β is between 90° and 120°.

6. The backpack of claim 1, wherein:

a longitudinal bar is fitted in each elongated slot of said first and second parts of said buckle; and each said shoulder strap portion extends at least partially around the longitudinal bar in said elongated slot through which said shoulder strap portion is looped.

7. The backpack of claim 1, wherein either said first part or said second part of said buckle is formed to define a recess between the portion of said part that define the elongated slots of said part.

8. The backpack of claim 1, wherein said first part and said second part of said buckle are each formed to define a recess between the portion of said part that define the elongated slots of said part.

9. The backpack of claim 8, wherein angle β is between 90° and 120°.

10. The backpack of claim 8, wherein each said first part or said second part is formed so that the recess is defined by side surfaces, each side surface being adjacent to and perpendicular to a separate one of the elongated slots and said side surfaces are at angle α relative to each other.

* * * * *